US009278524B2

(12) United States Patent
Long et al.

(10) Patent No.: US 9,278,524 B2
(45) Date of Patent: Mar. 8, 2016

(54) FLUID MANIFOLD AND METHODS OF MAKING THE SAME

(71) Applicant: FUNAI ELECTRIC CO., LTD., Osaka (JP)

(72) Inventors: Greg Long, Poway, CA (US); Jamey Anderson, Harrodsburg, KY (US); Brad Drews, Georgetown, KY (US)

(73) Assignee: Funai Electric Co., Ltd. (JP)

( * ) Notice: Subject to any disclaimer, the term of this patent is extended or adjusted under 35 U.S.C. 154(b) by 12 days.

(21) Appl. No.: 14/189,802

(22) Filed: Feb. 25, 2014

(65) Prior Publication Data

US 2015/0239245 A1 Aug. 27, 2015

(51) Int. Cl.

| | |
|---|---|
| ***B41J 2/15*** | (2006.01) |
| ***B41J 2/04*** | (2006.01) |
| ***B41J 2/14*** | (2006.01) |

(52) U.S. Cl.

CPC ..... *B41J 2/14145* (2013.01); *Y10T 29/49401* (2015.01)

(58) Field of Classification Search

CPC ..... B41J 2202/20; B41J 2/145; B41J 2002/14362; B41J 2002/14419; B41J 2002/14306

USPC ..... 347/20, 40, 45, 47, 54, 56, 61–63

See application file for complete search history.

(56) References Cited

U.S. PATENT DOCUMENTS

| | | | | |
|---|---|---|---|---|
| 5,975,681 | A | 11/1999 | Ogasawara et al. | |
| 6,561,637 | B2 | 5/2003 | Hino | |
| 6,695,442 | B2 | 2/2004 | Kitahara | |
| 7,018,013 | B2 * | 3/2006 | Kusunoki | 347/47 |
| 7,040,737 | B2 | 5/2006 | Takata et al. | |

* cited by examiner

*Primary Examiner* — An Do

(74) *Attorney, Agent, or Firm* — Amster, Rothstein, Ebenstein LLP

(57) ABSTRACT

An ink manifold for use with a heater chip in an inkjet printhead, including a first planar surface and a second opposite planar surface, a plurality of ink channels located on the first planar surface of the ink manifold for supplying ink to the heater chip, and a plurality of ink ports located on the second opposite planar surface of the ink manifold, each of the plurality of ink ports being in liquid communication with a respective one of the plurality of ink channels, each of the plurality of ink channels having a bottom wall defined by bottom wall portions that rise from each ink port within the ink channel to a maximum height at an angle of at least 12 degrees.

15 Claims, 4 Drawing Sheets

FLUID MANIFOLD AND METHODS OF MAKING THE SAME

FIELD

The present invention related generally to inkjet printers, and more particularly, to ink manifolds that direct ink from ink reservoirs to heater chips.

BACKGROUND

FIG. 1 illustrates the top surface of a portion of a conventional heater chip 40, with an arrangement of backside ink trenches, one shown as numeral 46. The backside ink trench 46 receives a supply of ink and couples the ink internally to the individual heater chambers where the ink is nucleated to form a droplet of ink that is jetted from a nozzle plate (not shown), which is situated on the bottom side of the heater chip 40. The backside ink trench 46 can be supplied with an ink having a magenta color. In like manner, the backside ink trench 48 can be supplied with a cyan colored ink, and the backside ink trench 50 can be supplied with a yellow colored ink. Lastly, in the example, the two backside ink trenches 52 and 54 can both be supplied with a black colored ink. The rows and columns of nozzles are located on the bottom surface of the heater chip 40.

Attached to the backside ink trench side of the heater chip 40 is a conventional ink manifold 42, only a portion of which is shown. The length of the ink manifold 42 can be somewhat longer than, or the same length as the heater chip 40. In any event, the ink channels on the bottom of the ink manifold 42 are closed channels, although the cross section shown in FIG. 1 is through the ink channel features. There is thus one ink manifold 42 for each heater chip 40. The staggered heater chips 40 and associated manifolds 42 are mounted to a page wide plastic or ceramic base member (not shown). The base member communicates the supply of the various ink colors from the respective ink supply reservoirs to the ink manifold 42.

The ink manifold 42 includes elongate ink channels that are mirror images of the backside ink trenches 46-54 of the heater chip 40. The manifold ink channel 56 supplies ink to the backside ink trench 46 of the heater chip 40, and ink channels 58 and 60 supply respective colored inks to the associated backside ink trenches 48 and 50. A larger-width ink channel 62 of the manifold 42 supplies black ink to both of the backside ink trenches 52 and 54 of the heater chip 40. The ink manifold 42 is constructed with a number of ink ports on the top side thereof, where each ink port is connected internally to a respective ink channel. In particular, the ink port 64 is coupled to channel 56, ink port 66 is coupled to channel 58, ink port 68 is coupled to channel 60 and ink port 70 is coupled to channel 62. The ink ports are illustrated as being square or rectangular, but could be other shapes. As noted above, situated over the ink manifold 42 is a base member for interfacing the manifold 42 to the different sources of liquid ink.

FIG. 2 is a cross-sectional view through line A-A of FIG. 1. As shown in FIG. 2, the manifold ink channel 56 has a foot-like design, which a heel section 45 and a toe section 47. The other ink channels 58, 60 and 62 have a similar design. There is a known issue where air bubbles are 'trapped' in the toe region of the ink channels. Due to the non-uniform velocity field in the channel, air is not completely removed during priming operations. This air bubble grows over time with normal use and frequent maintenance operations are required to keep the air volume at a low enough level to allow defect free print quality.

SUMMARY OF THE INVENTION

According to an exemplary embodiment of the present invention, an ink manifold for use with a heater chip in an inkjet printhead comprises: a first planar surface and a second opposite planar surface; a plurality of ink channels located on the first planar surface of the ink manifold for supplying ink to the heater chip; and a plurality of ink ports located on the second opposite planar surface of the ink manifold, each of the plurality of ink ports being in liquid communication with a respective one of the plurality of ink channels; each of the plurality of ink channels having a bottom wall defined by bottom wall portions that rise from each ink port within the ink channel to a maximum height at an angle of at least 12 degrees.

In at least one embodiment, the angle is within a range of 20 degrees to 30 degrees.

In at least one embodiment, the ink manifold is made of ceramic.

In at least one embodiment, the ink ports associated with each one of the plurality of ink channels are offset from the ink ports associated with each adjacent one of the ink channels.

In at least one embodiment, a plurality of ink manifolds are attached to a corresponding number of heater chips to define respective printhead components, and the printhead components are mounted to a base member having ink passageways for carrying plural colors of ink from respective ink reservoirs to the ink ports of each ink manifold.

In at least one embodiment, the base member is made of plastic.

In at least one embodiment, a gasket seal joins the plurality of ink manifolds to the base member.

In at least one embodiment, each ink manifold is joined to the corresponding number of heater chips by adhesive.

In at least one embodiment, the plurality of ink ports are separated by a distance within a range of 2.5 mm to 3.5 mm.

According to an exemplary embodiment of the present invention, a method of fabricating an ink manifold for use with a heater chip in an inkjet printhead comprises the steps of: providing an ink manifold substrate; forming a plurality of ink channels in one surface of the ink manifold substrate so as to be in liquid communication with respective backside ink trenches of the heater chip when the ink manifold is bonded to the heater chip; forming a plurality of ink ports in an opposite surface of the ink manifold substrate, each of the plurality of ink ports being in liquid communication with a respective one of the plurality of ink channels; each of the plurality of ink channels having a bottom wall defined by bottom wall portions that rise from each ink port within the ink channel to a maximum height at an angle of at least 12 degrees.

Other features and advantages of embodiments of the invention will become readily apparent from the following detailed description, the accompanying drawings and the appended claims.

BRIEF DESCRIPTION OF THE DRAWINGS

The features and advantages of exemplary embodiments of the present invention will be more fully understood with reference to the following, detailed description when taken in conjunction with the accompanying figures, wherein:

FIG. 3A top side perspective view of a fluid manifold according to an exemplary embodiment of the present invention;

DETAILED DESCRIPTION

Figure 1:
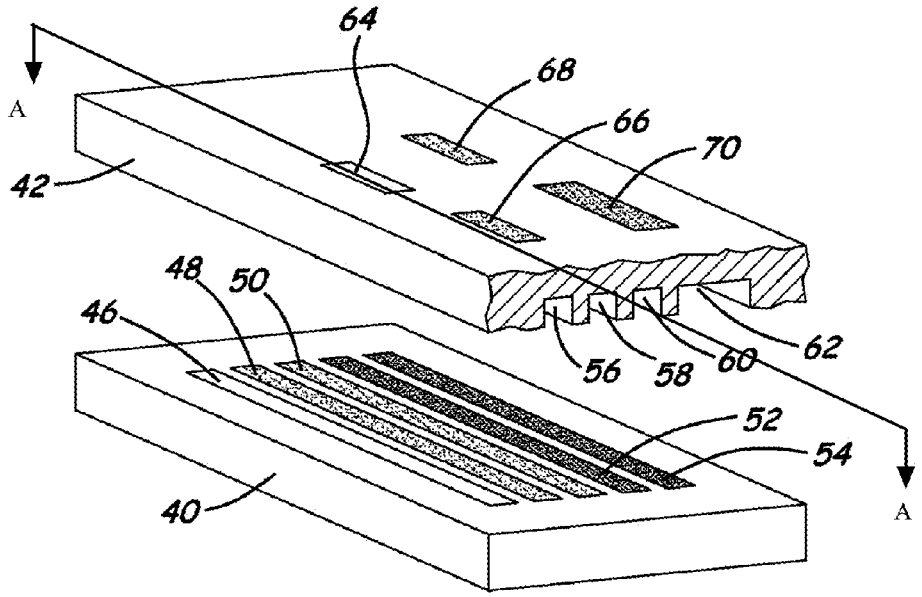
FIG. 1 is a partial perspective view of a conventional heater chip and ink manifold.
Figure 2:
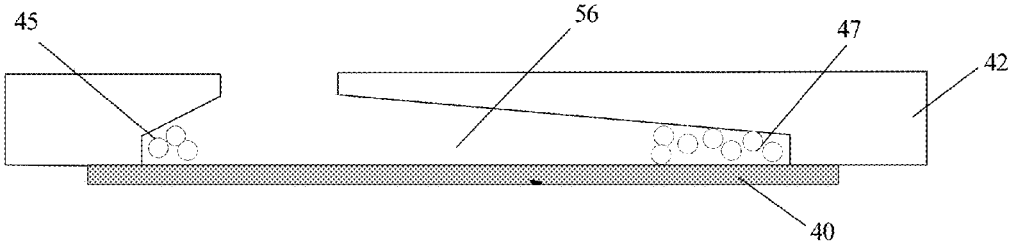
FIG. 2 is a cross-sectional view through the line A-A in FIG. 1.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

Figure 3A:
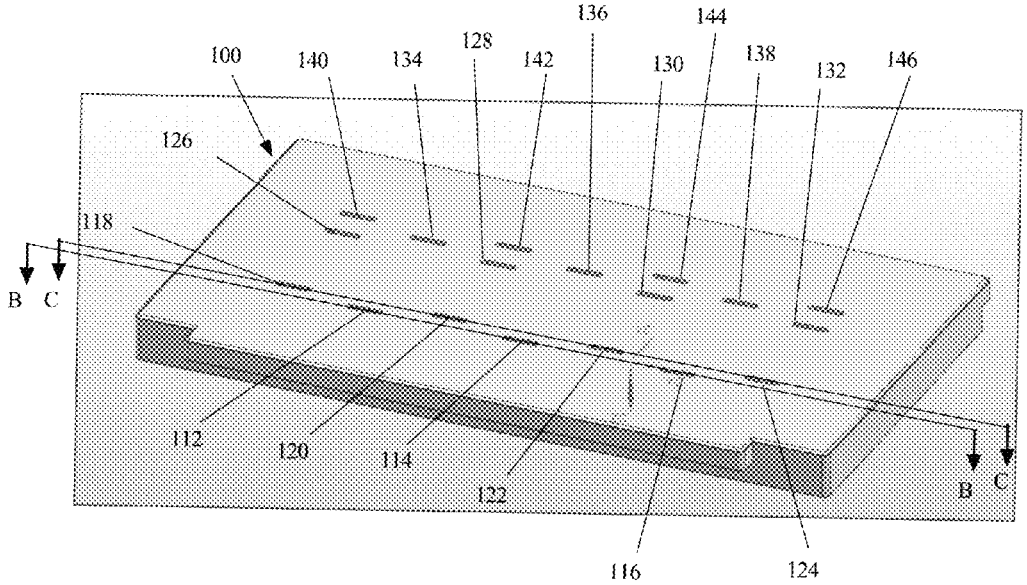
Figure 3B:
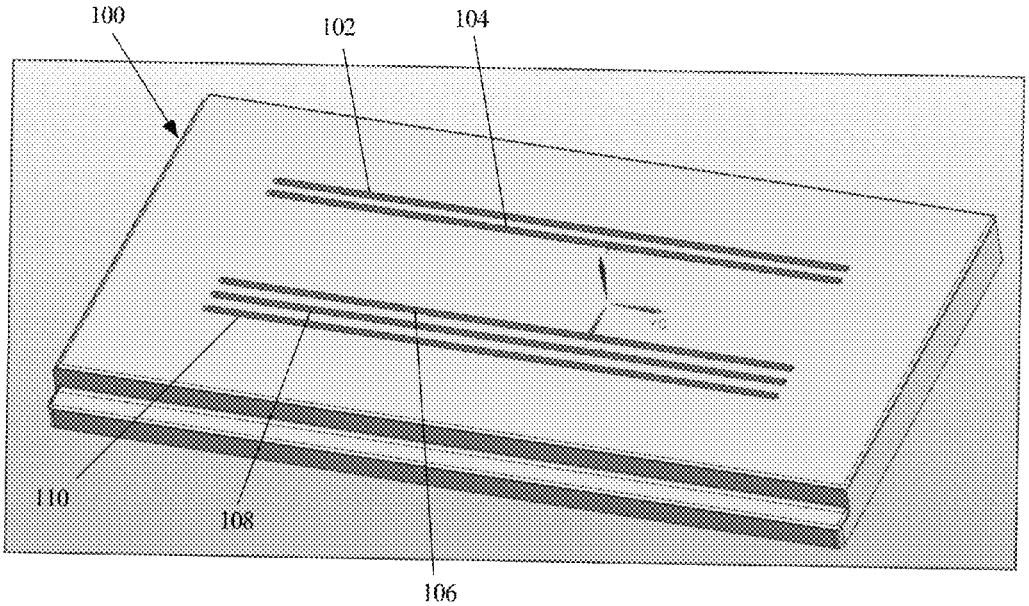
FIG. 3B is a bottom side perspective view of a fluid manifold according to an exemplary embodiment of the present invention.

FIG. 3A is a top side perspective view of a fluid manifold, generally designated by reference number 100, according to an exemplary embodiment of the present invention and FIG. 3B is a bottom side perspective view of the fluid manifold 100. The fluid manifold 100 is intended for use in an inkjet printer to deliver fluid, such as ink, to a heater chip, which in turn has the ability to jet the ink through a nozzle plate onto a substrate, such as paper. Such heater chips are well known in the art, and an exemplary heater chip is described in U.S. Pat. No. 8,210,660, the contents of which are incorporated herein by reference.

The fluid manifold 100 includes elongate fluid channels that are mirror images of backside ink trenches of the heater chip (such as the conventional heater chip shown in FIG. 1). In particular, the fluid channel 102 supplies ink to the backside ink trench 54 of the heater chip 40, the fluid channel 104 supplies ink to the backside ink trench 52 of the heater chip 40, the fluid channel 106 supplies ink to the backside ink trench 50 of the heater chip 40, the fluid channel 108 supplies ink to the backside ink trench 48 of the heater chip 40, and the fluid channel 110 supplies ink to the backside ink trench 46 of the heater chip 40. The fluid channels 102-110 may deliver different colored inks to each of the corresponding backside ink trenches 46-54 of the heater chip 40, such as, for example, cyan, magenta, yellow and black ink. In an alternative embodiment, the fluid channels 102 and 104 may be combined into a larger-width ink channel that supplies black ink to both of the backside ink trenches 52 and 54 of the heater chip 40.

The ink manifold 100 is constructed with a number of fluid ports on the top side thereof, where each fluid port is connected internally to a respective fluid channel. In particular, ink ports 112, 114, 116 are coupled to fluid channel 102, fluid ports 118, 120, 122, 124 are coupled to fluid channel 104, fluid ports 126, 128, 130, 132 are coupled to fluid channel 106, fluid ports 134, 136, 138 are coupled to fluid channel 108, and fluid ports 140, 142, 144, 146 are coupled to fluid channel 110. The ink ports are illustrated as being square or rectangular, but could be other shapes. A base member (not shown) is disposed over the ink manifold 100 for interfacing the manifold 100 to the different sources of liquid ink.

Figure 3C:
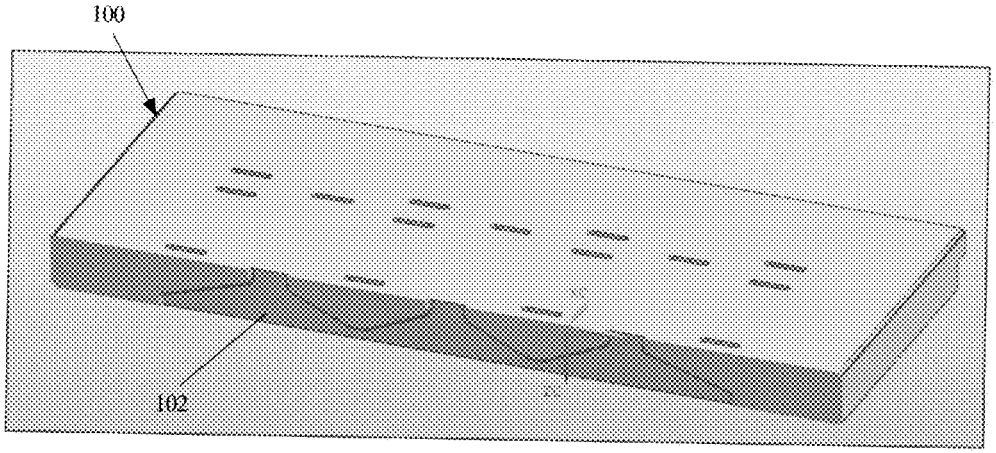
FIG. 3C is a cross-sectional view through line B-B of FIG. 3A.
Figure 3D:
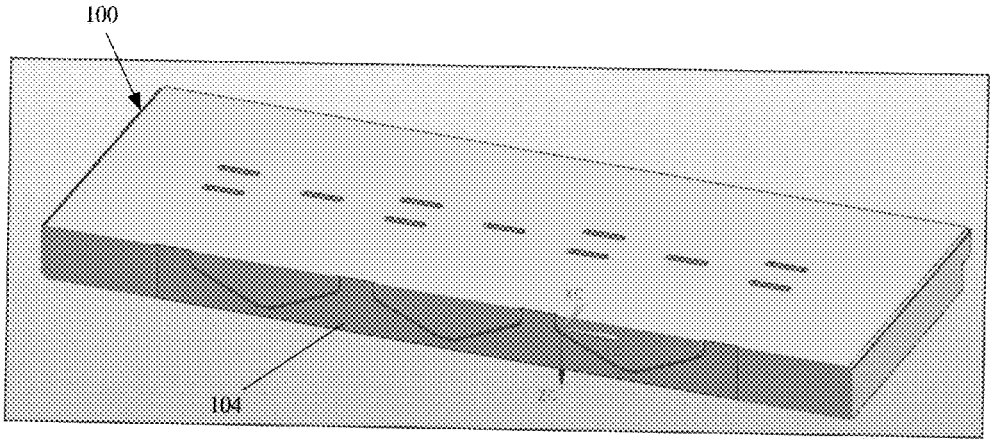
FIG. 3D is a cross-sectional view through line C-C of FIG. 3A.

FIG. 3C is a cross-sectional view through line B-B of FIG. 3A, and FIG. 3D is a cross-sectional view through line C-C of FIG. 3A. As shown in FIG. 3C, the depth of each fluid channel varies along its length, and in particular, bottom wall portions of the fluid channel rise to a maximum height between each fluid port so that each fluid channel is shallowest between each fluid port. In this regard, the bottom wall portions on either side of each fluid port flare out from one another. For example, the bottom wall portions 111, 113 on either side of the fluid port 112 rise from an ink port to a maximum height at an angle of at least 12° as measured from the top surface of the manifold, and in a preferred embodiment the angle is within the range of 20° to 30°. The angle is selected so that the depth profile of the fluid channels optimize air bubble mobility. In particular, the higher angle compared to conventional manifolds results in a more uniform velocity field capable of moving greater portion of bubbles out of the fluid channels. The higher angled geometry allows buoyancy force to move bubbles into the flow stream, minimizes amount of low velocity regions that can potentially trap air bubbles, and reduces total volume of ink required to evacuate air bubbles, which increases maintenance efficiency.

Figure 4:
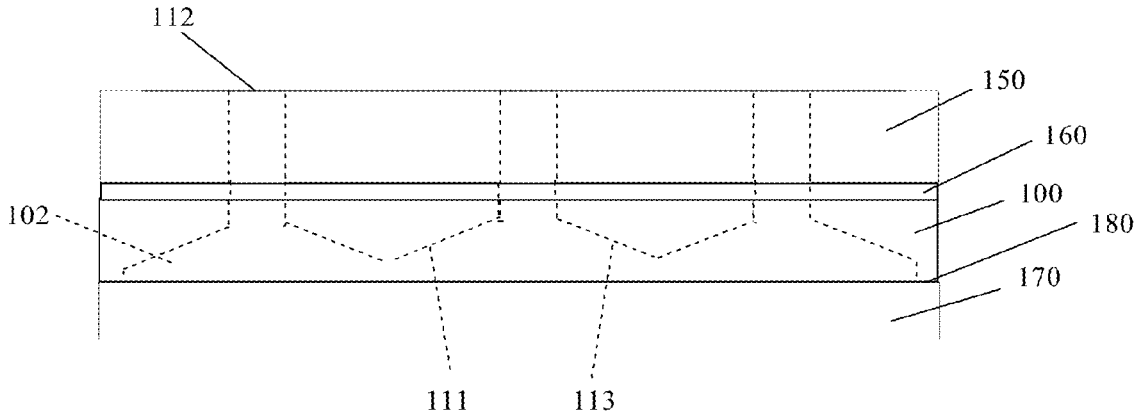
FIG. 4 is a cross-sectional view showing a fluid manifold joined with a base member and a heater chip according to an exemplary embodiment of the present invention.

As mentioned previously, the non-chip (top) surface of the fluid manifold 100 is fluidly connected to a plastic substrate which supplies filtered ink to the manifold 100 through the fluid ports 112-146. The manifold 100 may be made of ceramic. As shown in FIG. 4, in the case of ceramic, the connection between the fluid manifold 100 and the plastic substrate 150 is a gasket seal 160. The gasket seal 160 may be made of a compliant material, such as, for example, nitrile, propylene, silicone, polyurethane, and neoprene. In general, adhesive seals between ceramic and plastics are problematic due to the large differences in thermal expansion rates. This often causes adhesive joints to fail when large temperature changes take place. An adhesive 180 may be used to join the manifold 100 with a heater chip 170.

By providing multiple smaller fluid ports on the non-chip side that are offset as shown in FIG. 3A, enough area is maintained between the fluid ports to allow a reliable gasket seal. In this regard, adjacent fluid ports are preferably separated by a distance within a range of 2.5 mm to 3.5 mm (as measured from a corner of one port to the closest corner of an adjacent port).

While particular embodiments of the invention have been illustrated and described, it would be obvious to those skilled in the art that various other changes and modifications may be made without departing from the spirit and scope of the invention. It is therefore intended to cover in the appended claims all such changes and modifications that are within the scope of this invention.

What is claimed is:

1. An ink manifold for use with a heater chip in an inkjet printhead, comprising:

a first planar surface and a second opposite planar surface;

a plurality of ink channels located on the first planar surface of the ink manifold for supplying ink to the heater chip, the plurality of ink channels in liquid communication with respective backside ink trenches of the heater chip; and a plurality of ink ports located on the second opposite planar surface of the ink manifold, each of the plurality of ink ports being in liquid communication with a respective one of the plurality of ink channels;

each of the plurality of ink channels having a bottom wall defined by bottom wall portions that rise from each ink port within the ink channel to a maximum height at an angle of at least 12 degrees.

2. The ink manifold of claim 1, wherein the angle is within a range of 20 degrees to 30 degrees.

3. The ink manifold of claim 1, wherein the ink manifold is made of ceramic.

4. The ink manifold of claim 3, wherein a plurality of ink manifolds are attached to a corresponding number of heater chips to define respective printhead components, and the printhead components are mounted to a base member having ink passageways for carrying plural colors of ink from respective ink reservoirs to the ink ports of each ink manifold.

5. The ink manifold of claim 4, wherein the base member is made of plastic.

6. The ink manifold of claim 4, wherein each ink manifold is joined to the corresponding number of heater chips by adhesive.

7. The ink manifold of claim 5, further comprising a gasket seal that joins the plurality of ink manifolds to the base member.

8. The ink manifold of claim 1, wherein the ink ports associated with each one of the plurality of ink channels are offset from the ink ports associated with each adjacent one of the ink channels.

9. The ink manifold of claim 1, wherein the plurality of ink ports are separated by a distance within a range of 2.5 mm to 3.5 mm.

10. A method of fabricating an ink manifold for use with a heater chip in an inkjet printhead, comprising:

providing an ink manifold substrate;

forming a plurality of ink channels in one surface of the ink manifold substrate so as to be in liquid communication with respective backside ink trenches of the heater chip when the ink manifold is bonded to the heater chip;

forming a plurality of ink ports in an opposite surface of the ink manifold substrate, each of the plurality of ink ports being in liquid communication with a respective one of the plurality of ink channels;

each of the plurality of ink channels having a bottom wall defined by bottom wall portions that rise from each ink port within the ink channel to a maximum height at an angle of at least 12 degrees.

11. The method of claim 10, wherein the angle is within the range of 20 degrees to 30 degrees.

12. The method of claim 10, wherein the ink manifold is made of ceramic.

13. The method of claim 12, further comprising the step of joining the ink manifold to a base member using a gasket seal, the base member having ink passageways for carrying plural colors of ink from respective ink reservoirs to the plurality of ink ports.

14. The method of claim 10, wherein the ink ports associated with each one of the plurality of ink channels are offset from the ink ports associated with each adjacent one of the ink channels.

15. The method of claim 10, wherein the plurality of ink ports are separated by a distance within a range of 2.5 mm to 3.5 mm.

* * * * *